United States Patent [19]

Granger et al.

[11] Patent Number: 4,930,745

[45] Date of Patent: Jun. 5, 1990

[54] VARIABLE BORE RAM RUBBER

[76] Inventors: Stanley W. Granger, 23800 Gold Nugget, Diamond Bar, Calif. 91765; Joseph O. Beard, %31 Molino, Long Beach, Calif. 90814; Frode Sveen, 12697 Orgen Ave., Chino, Calif. 91710

[21] Appl. No.: 188,267

[22] Filed: Apr. 29, 1988

[51] Int. Cl.[5] ..... E21B 33/06

[52] U.S. Cl. ..... 251/1.1; 251/1.2; 251/1.3; 277/126; 277/127; 277/192; 277/199

[58] Field of Search ..... 277/127, 126, 192, 199; 251/1.1, 1.2, 1.3

[56] References Cited

U.S. PATENT DOCUMENTS

| | | | |
|---|---|---|---|
| 3,915,424 | 10/1975 | LeRouax | 251/1.1 |
| 4,332,367 | 6/1982 | Nelson | 251/1.3 |
| 4,444,404 | 4/1984 | Parks, Jr. | 251/1.2 X |
| 4,770,387 | 9/1988 | Granger | 251/1.1 X |

*Primary Examiner*—Allan N. Shoap
*Attorney, Agent, or Firm*—William L. Chapin

[57] ABSTRACT

An improved sealing element for variable bore ram blowout preventers of the type using two semicircular ram blocks to urge a resilient sealing member into sealing circumferential contact with the circumferential surface of a tubular drill string component includes a generally uniform thickness member having in plan view the shape of a semi-circular arch with bar-shaped legs extending laterally outwards from opposite base ends of the arch. A plurality of metal inserts forms a skeletal structure around which is molded a rubber matrix to form the sealing member. Each insert has a pair of generally flat and parallel upper and lower plates joined together by a pedestal and interleaved with and slidable with respect to the plates of an adjacent insert. Two outer generally rectangular plan-view end inserts have inner lateral edges which slidably interleave with the two outer elongated rectangular lateral ends of each of two intermediate corner inserts. Each of the two corner inserts has an arcuate inner end which slidably interleaves with opposite ends of a single arcuate center insert. The pedestals joining the upper and lower halves of the two corner inserts, and the pedestal joining upper and lower halves of the center insert, each have different tear-drop shaped cross-sectional shapes which promote rubber flow into the sealing area when the seal is compressed.

9 Claims, 6 Drawing Sheets

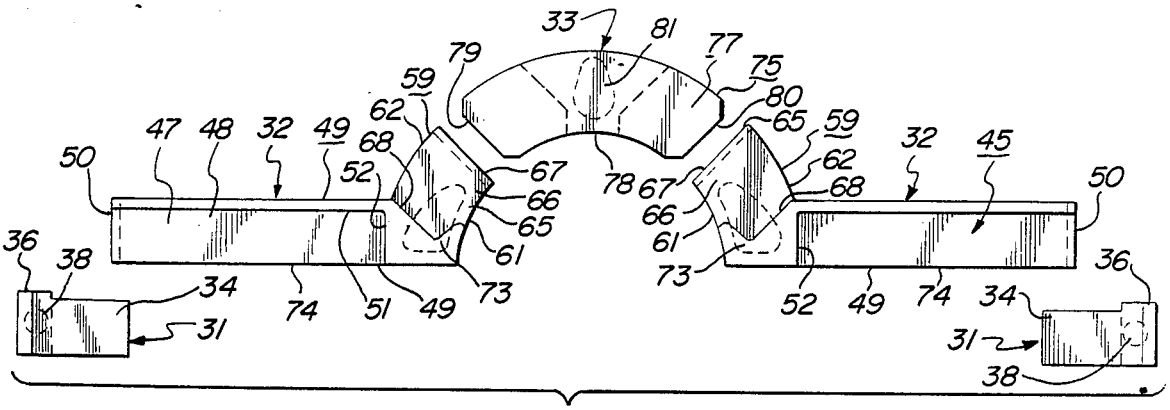
FIG. 2
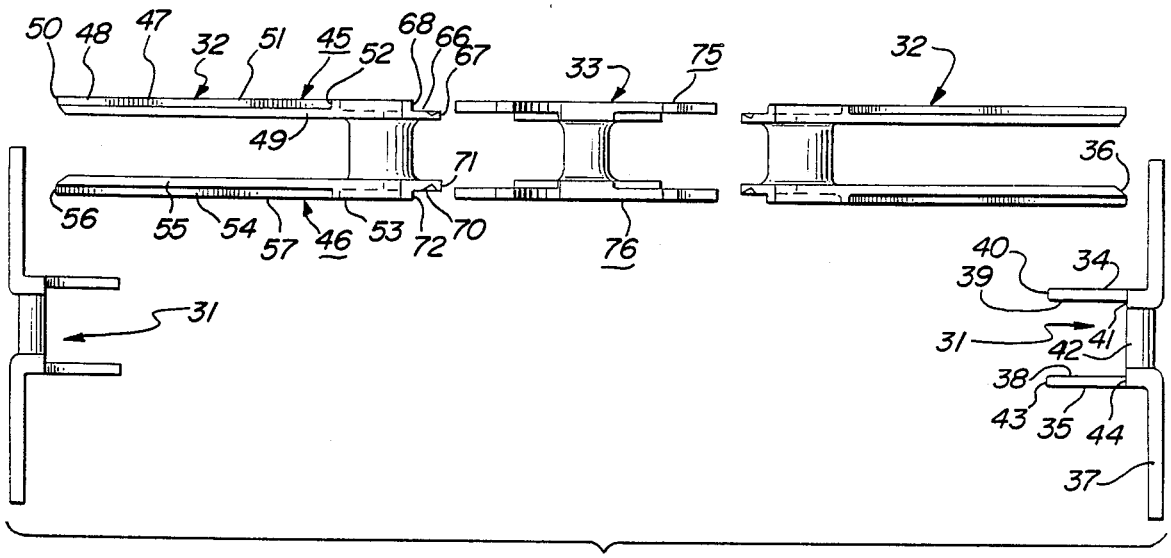
FIG. 3
FIG. 4
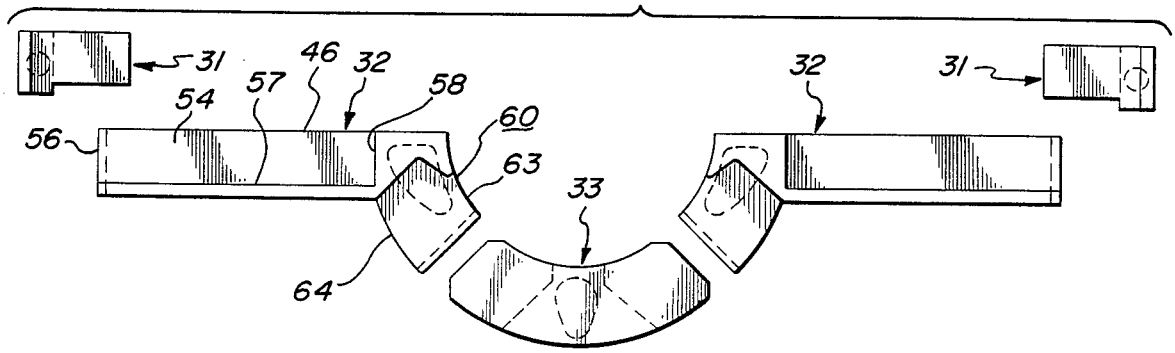

VARIABLE BORE RAM RUBBER

BACKGROUND OF THE INVENTION

A. Field of the Invention

The present invention relates to devices used in the drilling and operation of subterranean and subsea wells, primarily oil and gas wells. More particularly the invention relates to an improvement in the seals or ram rubbers used in variable bore ram blowout preventers, for preventing pressurized gases or liquids from blowing out of the well.

B. Discussion of Background Art

In drilling for natural gas or liquid petroleum, a drill string consisting of many lengths of threaded pipes screwed together and terminated by a drill bit head is used to bore through rock and soil. The drill bit head has a larger diameter than the pipes forming the drill string above it. The upper end of the drill string is rotated to transmit a rotary boring action to the drill bit head.

A specially formulated mud is introduced into an opening in an upper drill pipe, flowing downward through the hollow interior of the pipes in the drill string and out through small holes or jets in the drill bit head. Since the drill bit head has a larger diameter than the drill string above it, an elongated annular space is created during the drilling process which permits the mud to flow upwards to the surface. The purpose of the mud is to lubricate the rotating drill string, and to provide a downward hydrostatic pressure which counteracts pressure which might be encountered in subsurface gas pockets.

In normal oil well drilling operations, it is not uncommon to encounter subsurface gas pockets whose pressure is much greater than could be resisted by the hydrostatic pressure of the elongated annular column of drilling mud. To prevent the explosive and potentially dangerous and expensive release as gas and/or liquid under pressure upwards out through the drilling hole, blowout preventers are used. Blowout preventers are mounted in a pipe casing surrounding a drill hole, near the upper end of the hole.

Typical blowout preventers have a resilient sealing means which can be caused to tightly grip the outer circumferential surfaces of various diameter drill string components, preventing pressure from subterranean gas pockets from blowing out material along the drill string. Usually, the resilient sealing means of a blowout preventer is so designed as to permit abutting contact of a plurality of individual sealing segments, when all elements of a drill string are removed from the casing. This permits complete shutoff of the well, even with all drill string elements removed. Most oil well blowout preventers are remotely actuable, as by a hydraulic pressure source near the drill hole opening having pressure lines running down to the blowout preventer.

Ram blowout preventers (BOP's) utilize a pair of opposed semicircular disc-shaped sealing elements driven radially inwards into peripheral sealing contact with tubular pipe or similar drill string component extending through the bore of the BOP. Each of the semicircular ram sealing elements has a flat diametrical face into which a coaxial, semicircular notch is cut. The notches are adapted to conformally engage opposite halves of the cylindrical surface of a tubular drill string component.

Usually, resilient elements are incorporated into the ram sealing elements which allow the notched faces of the two sealing elements to form a tight seal against one another and against the periphery of the tubular drill string component. Providing resilient elements allows a pressure tight seal to be made around the periphery of tubular drill string components having a slight variation in outer diameter. The seal must be effective against well-hole pressures as high as 15,000 psi.

Variable bore ram rubbers or sealing elements are used in the drilling and workover of deep oil and gas wells when the drill string is made up of pipes of different sizes forming what is referred to as a tapered string. Ram rubbers of variable bore design are adapted to effect pressure tight seals against the peripheral surface of pipes of various diameters.

Variable bore rams in current use employ a special variable bore ram block which is different than fixed diameter ram blocks. The special variable bore ram blocks having a deeper cavity or, "rubber pocket" which is necessary to provide sufficient rubber to effect a positive seal. Because of the use of special ram blocks, variable bore ram assemblies are considerably more expensive than standard, fixed bore ram assemblies. Consequently, most small drilling operators do not use variable bore ram assemblies, and their use is limited even among larger operators. However, more extensive use of variable bore rams would be desirable, since such use can provide substantial savings in operating time, by eliminating the requirement of halting movement of drill pipe to change to a different size fixed bore ram assembly for each size of pipe in a drill string.

In addition to the operating time savings afforded by the use of a variable bore ram, there are safety advantages. Thus, a variable bore ram assembly may be actuated to form an effective blowout seal on piping of any diameter in the bore of the ram assembly.

On the other hand, with a fixed bore ram blowout preventer, if a drill string needs to be pulled quickly due to some emergency, the fixed bore ram assembly is unable to effect a seal when piping of smaller diameter than that which it is designed to seal is present in the bore of the ram assembly.

From the foregoing discussion, it should be apparent that it would be desirable to provide a new variable bore ram rubber which would fit in a standard, fixed bore pipe ram block. Also, it would be desirable to provide a new variable bore ram rubber which would overcome certain limitations inherent in existing variable bore ram rubbers, as will now be described.

Existing variable bore ram rubbers typically include a uniform thickness sealing element generally shaped in plan view cross section somewhat like a symmetrical semicircular arch. Additionally, some sealing elements have straight, coplanar legs joining the opposite ends of the arch, and extending laterally outwards therefrom. One such sealing element is installed in each of two opposed, semicircular ram blocks, the flat bases of the legs of opposing sealing elements abutting each other to form a pressure tight seal, and the concave semicircular surfaces of opposed arches sealing against opposite cylindrical sides of a tubular drill string component passing through the bore of the ram sealing assembly, the bore being defined by the union of the two semicircular cross-section arches.

To provide the necessary resilience to form an effective seal, existing sealing elements are usually made of metal segments or inserts interspersed in a molded rubber matrix. Typically, the metal segments or inserts are coextensive with the thickness dimension of the sealing element. Those inserts in the arch shaped section of the sealing element generally have a pie-shaped plan view cross-sectional shape, while the inserts in the legs joining the arch typically have rectangular cross sections.

The resilient sealing elements of ram blowout preventers require rugged metal inserts to be interspersed with the resilient rubber matrix to add strength to the sealing elements. Such strength is required because the required sealing forces on a five-inch diameter pipe can be as high as 500,000 lbs. Also, the sealing element is sometimes required to grip a long string of drill pipe to prevent it from falling down into the well hole. The weight of a string of 5-inch drill pipes can approach the tensile strength of the pipe, or 600,000 lbs.

Existing prior art variable bore ram sealing elements use a large number of metal inserts segments, typically 10 to several dozen. The large number of segments is used to permit the sealing elements to conform to various pipe sizes, usually in the range diameter between 3½ inches and 5 inches.

Prior art variable bore ram sealing elements utilizing a large number of metal segments include Nelson, U.S. Pat. No. 4,332,367, July 1, 1982, which discloses the use of non-overlapping segments, and Le Rouax, 3,915,426, Oct. 28, 1975, which discloses the use of overlapping segments.

The use of a substantial number of metal segments in existing variable bore ram sealing elements has a number of disadvantages. One such disadvantage results from the fact that every interface between segments has rubber which can extrude between the segments. Extruded rubber is pinched and cut off each time the seal is compressed into a closed position, decreasing the life of the seal.

Another disadvantage of using a large number of metal segments in a variable bore ram sealing element is that the small size of the segments makes their movement towards one another during compressive sealing somewhat unpredictable, owing to fact that some segments will stick and some will move more readily than others. This causes gaps in sealing effectiveness to occur, especially at the corners of the sealing elements, i.e., the junctions between the straight legs and arch of a sealing element half. Also, it would be desirable for the sealing element to have greater strength at the corners, where stresses are greater during compressive sealing. This strengthening is not feasible with existing sealing elements which employ a large number of metal segments of generally uniform size and shape.

With the aforementioned limitations of prior existing variable bore ram rubber seals in mind, the present invention was conceived of.

OBJECTS OF THE INVENTION

An object of the present invention is to provide an improved variable bore ram rubber for ram blowout preventers having greater potential useful life than existing variable bore ram rubbers.

Another object of the invention is to provide a variable bore ram rubber which is usable in a variety of ram blocks.

Another object of the invention is to provide a variable bore ram rubber which can seal effectively around the periphery of tubular well components having a substantial range of different outer diameters.

Another object of the invention is to provide a variable bore ram rubber having metal segments which coact with one another and with the resilient matrix in which they are embedded to move in repeatable fashion when the ram rubber is compressed and released to close around or release a tubular drill string component.

Another object of the invention is to provide a variable bore ram rubber having a reduced number of metal insert segments.

Another object of the invention is to provide a variable bore ram rubber having different shaped inserts in different locations within the resilient matrix of the ram rubber, each shape being advantageously shaped to perform optimally at its particular location.

Another object of the invention is to provide a variable bore ram rubber which conforms exactly to the outer cylindrical wall surface of the largest pipe which the ram rubber is intended to accept, while conforming to substantially smaller pipes with a minimal amount of extrusion of resilient material.

Another object of the invention is to provide a variable bore ram rubber which has an enhanced capability for safely supporting various diameter tubular drill string components, including tapered components, of great weight.

Various other objects and advantages of the present invention, and its most novel features, will be particularly pointed out in this disclosure.

It is to be understood that although the invention disclosed herein is fully capable of achieving the objects and providing the advantages mentioned, the structural and operational characteristics of the invention described herein are merely illustrative of the preferred embodiments. Accordingly, we do not intend that the scope of our exclusive rights and privileges in the invention be limited to the details of construction and operation described. We do intend that equivalents, adaptations and modifications of the invention which may be reasonably construed to employ the novel concepts of the invention described herein be included within the scope of the invention as defined by the appended claims.

SUMMARY OF THE INVENTION

Briefly stated, the present invention comprehends an improved sealing element or ram rubber for variable bore ram blowout preventers used in oil and gas wells and the like.

The novel variable bore ram rubber according to the present invention has a conventional appearing exterior shape adapted to fit into existing semi-circular ram blocks. Thus, each of the two identical halves of the variable bore ram rubber according to the present invention is of generally uniform thickness and has a symmetrical arch-shaped, semicircular center section. Coplanar, laterally disposed legs join opposite ends of the arch, and extend laterally outwards therefrom. One such sealing element is installed in each of two laterally opposed, semicircular ram blocks. When the ram blocks are forced towards one another into a sealing position, the flat bases of the legs of opposing sealing elements abut each other to form a pressure-tight seal, and the concave, semicircular surfaces of opposed arches seal against opposite cylindrical sides of a tubular drill string component disposed longitudinally through the bore of the ram sealing assembly, the bore being defined by the union of the two semicircular cross-section arches.

The variable bore ram rubber according to the present invention includes metal inserts molded into a matrix of resilient material such as hard rubber. In contrast to prior art variable bore ram rubbers, which have a large number of metal segments or inserts of similar size and shape, the novel variable bore ram rubber according to the present invention uses a small number of inserts of three different shapes, each shape being particularly adapted to the location of the insert in the ram rubber.

Thus, the variable bore ram rubber according to the present invention has two identical end inserts, one each at the outer lateral end of each lateral leg of the ram rubber, a center insert positioned inwards of the central arch of the ram rubber, and two identical corner inserts, located at the junctions between the lateral legs and the arch. Each of the five inserts is positioned symmetrically about the longitudinal mid-plane of the ram rubber, and is symmetrically shaped about that mid plane. Also, each of the inserts has identically shaped parallel plate-like upper and lower parts joined together by a columnar pedestal section disposed perpendicularly between the plates.

In plan view, the end inserts have generally rectangular shaped parallel upper and lower plates conforming to the rectangular shape of the lateral legs of the ram rubber. Formed in the outer lateral ends the upper and lower plates are perpendicularly upwardly and downwardly projecting bars, respectively, giving the end inserts in elevation view an "L" shape. The outer lateral portions of the upper and lower plates of the corner inserts are generally rectangular shaped, and contain rectangular grooves in their upper and lower surfaces, respectively, to slidingly receive the inner facing upper and lower plates, respectively, of an adjacent corner insert. The inner lateral portions of the upper and lower plates of the corner inserts have an arcuate plan view shape, and contain rectangular grooves in their upper and lower surfaces respectively, to slidingly receive the upper and lower plates, respectively of an adjacent end of the single center insert. The parallel upper and lower plates of the center insert have concentric arcuate upper (inner) and lower (outer) edges, and radially disposed lateral edges, forming an annular segment of a circle.

The novel shapes and cooperative interactibility of the plates of the variable bore ram rubber according to the present invention provide improved durability and reliability. Additionally, the cross-sectional shapes of the pedestals joining the upper and lower halves of the plates are specially contoured to optimize the cold-flow of resilient matrix material during the compression and expansion of the ram rubber during sealing and unsealing on a pipe. Also, the junctions between the vertical face and the upper and lower faces of the upper and lower plates of the center and corner inserts are milled to form an acute angle between the surfaces, rather than a ninety degree angle. The sharp edges formed by the acute angles are effective in gripping piping extending through the bore of the ram rubber, even if the pipe is tapered.

BRIEF DESCRIPTION OF THE DRAWINGS

FIG. 2 is a fragmentary, exploded view of the variable bore ram rubber of FIG. 1, showing a top plan view of the novel metal inserts used in the variable bore ram rubber.

FIG. 3 is a front elevation view of the inserts shown in FIG. 2.

FIG. 4 is a bottom plan view of the inserts shown in FIG. 2.

DESCRIPTION OF THE PREFERRED EMBODIMENTS

Figure 1:
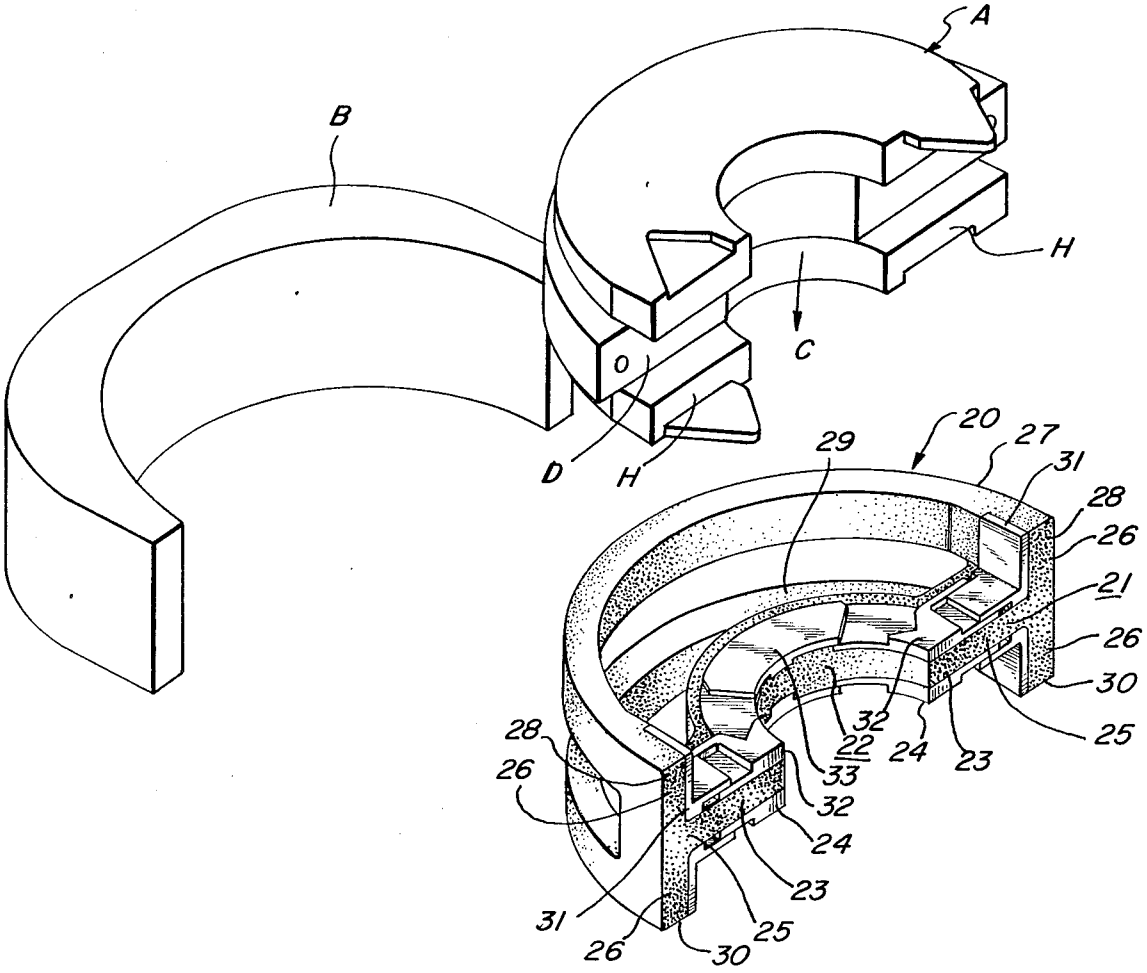
FIG. 1 is an exploded perspective view of the novel variable bore ram rubber according to the present invention, showing a typical blowout preventer ram block in which the ram rubber is intended to be installed.

Referring now to FIG. 1, a variable bore ram rubber according to the present invention is shown in relationship to a typical ram blowout preventer in which the ram rubber is intended to be installed.

The variable bore ram rubber 20 according to the present invention is adapted to fit around a generally semicircular cross-section ram block A and is secured thereto by a rear C-shaped holder B. In a ram blowout preventer, two ram blocks A are positioned with the semi circular bores C in the front diametrical faces D of the ram blocks facing each other to form a longitudinally disposed bore adapted to receive tubular drill string components. Thus, a separate variable bore ram rubber 20 is required for each half of a ram blow out preventer. In operation of a ram blowout preventer, hydraulic rams drive opposed ram blocks radially inwards towards one another to enclose a tubular well component.

As shown in FIG. 1, the variable bore ram rubber 20 according to the present invention has a uniform thickness central longitudinal part 21 having a centrally located semi circular, outwardly concave arch section 22. Laterally disposed legs 23 having a laterally elongated rectangular plan-view cross-sectional shape extend laterally outwards from opposite base ends 24 of arch section 22. The two legs 23 have coplanar outer wall surfaces 25. In front elevation view, the outer lateral ends of legs 23 have vertically elongated, rectangular bars 26 perpendicularly and symmetrically disposed with respect to the longitudinal center plane of the central longitudinal section 21. Thus, in elevation view, the cross sectional shape of legs 23 is that of two "T"s lying horizontally with their bases adjacent.

An upper semicircular ring 27 of generally rectangular cross sectional shape joins the upper ends 28 of the rectangular bars 26. An identical lower semicircular ring 29 in longitudinal alignment with the upper semicircular ring 27 joins the lower ends 30 of the rectangular bars 26.

The variable bore ram rubber 20 is molded of a rigid rubber such as nitrile. The central longitudinal section 21 of the ram rubber 20 contains metal inserts of novel design, molded into the rubber matrix, and which will now be described.

Referring to FIGS. 2 through 5, the novel metal inserts forming part of the central longitudinal section 21 of variable bore ram rubber 20 are shown prior to being molded into a rubber matrix. As shown in FIGS. 2 through 5, ram rubber 20 has two end inserts 31, two corner inserts 32, and one center insert 33, for a total of five inserts. Each of the inserts 31, 32 and 33 is symmetrically shaped about the longitudinal center plane of the ram rubber 20. Also, each of the inserts 31, 32 and 33 has generally parallel generally flat plate-like upper and lower members, and respectively, joined by a column-like pedestal disposed perpendicularly between the upper and lower members.

As shown in FIGS. 2 through 5, the upper and lower plates 34 and 35 of the end inserts 31 have in plan view a generally rectangular shape. The rectangular plates 34 and 35 are elongated laterally, and conform generally to the shape of the lateral legs 23 of the ram rubber 21. Extending perpendicularly upwards from the outer lateral edge of upper plate 34 of each end insert 31 is a rectangular bar or tab 36, of approximately the same width and thickness as the horizontal portion of the plate. Thus, the end upper portion of an end insert has in front or rear elevation view the shape of a "L". Similarly a rectangular bar or tab 37 extends downward from the outer lateral edge of the lower plate 35, forming an inverted "L" shape which is a mirror image of the aforementioned, upper "L" shape.

Upper plate 34 and lower plate 35 of end insert 31 are joined by an elongated, circular cross-section cylindrical pedestal 38 extending perpendicularly between adjacent inner faces of the plates. Pedestal 38 is positioned midway between the front and rear longitudinal edge faces of plates 34 and 35, and laterally inwards a slight distance from the common outer plane of the vertically disposed end bars 36 and 37.

As shown in FIG. 3, the lower surface 39 of upper plate 34 of end insert 31 is milled to form a reduced thickness section 40 having a perpendicularly disposed rear lateral shoulder 41 located inwards a slight distance from the pedestal 38. Similarly, the upper surface 42 of lower plate 35 of end insert 31 is milled to form a reduced thickness section 43 having a perpendicularly disposed rear lateral shoulder 44 located inwards a slight distance from the pedestal 38.

End inserts 31 are preferably made of ASTM A-487 steel having a hardness of Rc 22 max and a tensile strength of at least 90,000 psi. The corner inserts, and the center insert, must sometimes support the entire weight of a drill string, to prevent the drill string from falling down into the well hole when piping above the ram blowout preventer is no longer supported. Therefore, the corner and center inserts are preferably made of a stronger material, such as Inconel 718 having a hardness of Rc 35-40 and a tensile strength of at least 135,000 psi.

Each corner insert 32 has vertically aligned upper and lower plates 45 and 46, the outer lateral portions of which have a generally rectangular plan-view shape. The upper surface 47 of upper plate 45 has a longitudinally disposed, shallow, box-shaped groove 48. Groove 48 is cut perpendicularly backwards from the front edge wall 49 of plate 45, and laterally inwards from the outer lateral edge 50 of plate 45, to form a rear laterally disposed shoulder 51 and an inner perpendicularly disposed shoulder 52.

Similarly, lower plate 46 has cut in its lower surface 53 a shallow box-shaped groove 54. Groove 54 extends perpendicularly backwards from the front edge wall 55 of plate 46, and laterally inwards from the outer lateral edge 56 of plate 46, to form a rear laterally disposed shoulder 57 and an inner perpendicularly disposed shoulder 58.

Groove 48 in upper plate 45 of a corner insert 32, and groove 54 in lower plate 46 of the corner insert, are provided to slidingly receive the milled lower surface 39 of upper plate 34 of an adjacent end insert 31, and the milled upper surface 42 of the lower plate 35 of the end insert respectively.

The inner lateral portion of the upper and lower plates 45 and 46 of each corner insert 32 have vertically aligned, arcuate plan view sections 59 and 60, respectively. Upper arcuate section 59 has concentric inner and outer arcuate edge walls 61 and 62, respectively. Similarly lower arcuate section 60 has concentric inner and outer arcuate edge walls 63 and 64, respectively.

The upper surface 65 of upper arcuate section 59 has a shallow groove 66 extending arcuately inwards from the outer radial edge 67 of the arcuate section to terminate in a radially disposed shoulder 68 near the junction of the arcuate section with the rectangular section of upper plate 45 of a corner insert 32. Similarly, the lower surface 69 of lower arcuate section 60 of lower plate 46 of the corner insert 32 has a shallow grove 70 extending arcuately inwards from the outer radial edge 71 of the arcuate section to terminate in a radially disposed shoulder 72 near the junction of the arcuate section with the rectangular section of the upper plate.

Upper plate 45 and lower plate 46 of corner insert 32 are joined by an elongated, uniform cross-section pedestal 73 extending perpendicularly between adjacent inner faces of the plates. As may be seen best by referring to FIG. 2, the pedestal 73 has a transverse cross-sectional shape similar to that of a tear drop having a flattened large-end base parallel to the outer longitudinal edge 74 of plate 45 and positioned near the junction of the outer longitudinal edge with the inner arcuate edge wall 61 of plate 45. The major axis of the tear drop shape is skewed arcuately to approximately parallel the contour of the inner arcuate edge wall 61 of plate 45. The cross sectional area of pedestal 73 is substantial, underlying a substantial portion of upper and lower arcuate sections 59 and 60 of upper and lower plates 45 and 46, respectively. The cross sectional shape of pedestal 73 performs a advantageous function in the operation of the ram rubber 20, as will be described later.

As shown in FIGS. 2 through 5, the variable bore ram rubber 20 according to the present invention has a single center insert 33. Center insert 33 has identically shaped vertically shaped upper and lower plate sections 75 and 76, respectively. Plate sections 75 and 76 have in plan view the shape of annular sectors of a circle having concentric outer (rear) and inner (front) arcuate edge walls 77 and 78, respectively, and left and right radial edge walls 79 and 80, respectively. The inner facing surfaces of upper plate section 75 and lower plate section 76 are undercut some distance inwards from radial edge walls 79 and 80 to form reduced thickness laterally disposed flanges adapted to slidingly engage arcuate grooves 66 and 70 of upper arcuate section 59 and lower arcuate section 60, respectively, of adjacent corner inserts 32.

Upper plate 75 and lower plate 76 of center insert 33 are joined by an elongated uniform cross-section pedestal 81 extending perpendicularly between adjacent inner faces of the plates. As may be seen best by referring to FIG. 2, the pedestal 81 has a transverse cross-sectional shape similar to that of a tear drop, with the major axis of tear drop aligned with the radial plan-view bisector of the plates. The small end of the tear drop faces rearward towards the outer or rear arcuate edge wall 77 of plates 75 and 76. The cross sectional area of pedestal 81 is substantial, and its shape is adapted to perform a advantageous function in the operation of the ram rubber 20, as will be described below.

Figure 5:
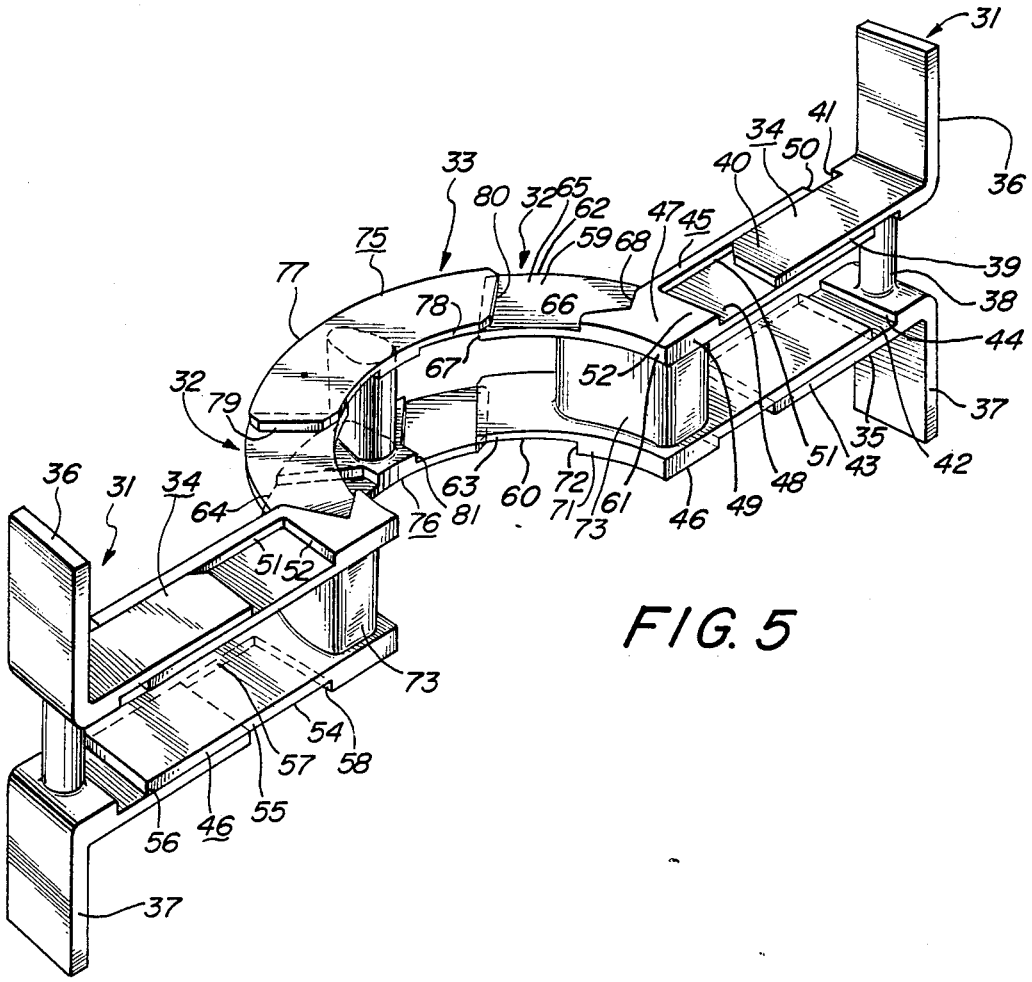
FIG. 5 is a skeletal perspective view of the novel metal inserts used in the variable bore ram rubber of FIG. 1, prior to molding a rubber matrix around the inserts, and showing how each insert may slidably engage an adjacent insert.
Figure 6:
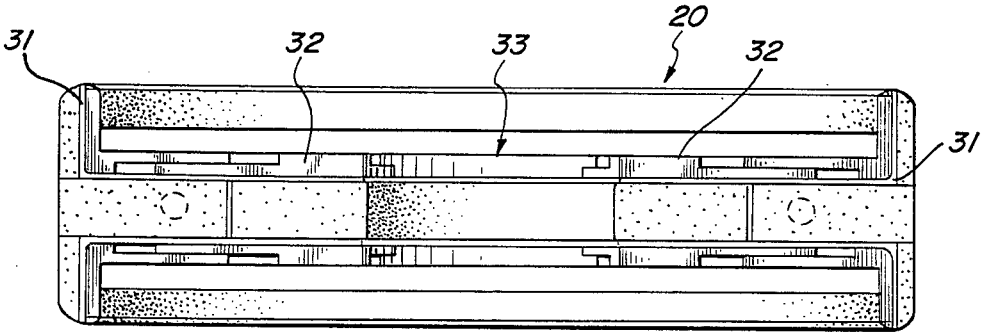
FIG. 6 is a front elevation view of the variable bore ram rubber of FIG. 1.
Figure 7:
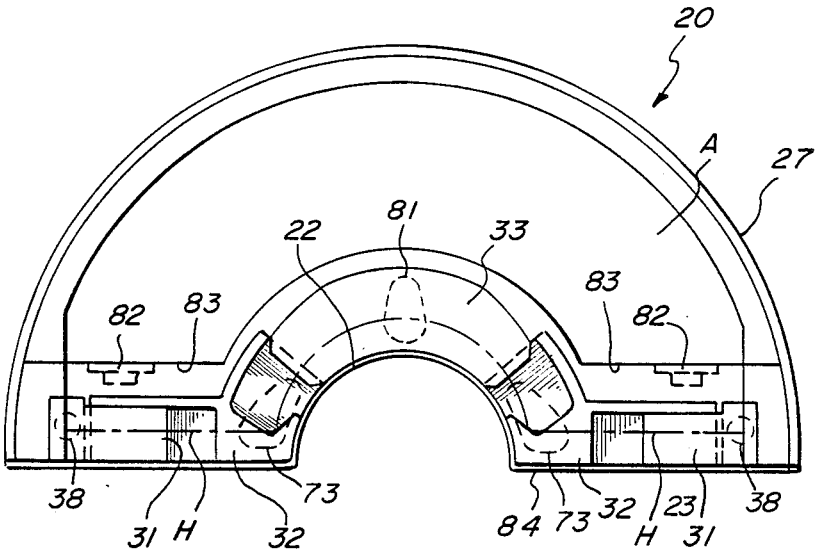
FIG. 7 is an upper plan view of the variable bore ram rubber of FIG. 1, showing the ram rubber in a relaxed, uncompressed position, with no tubular member present in its bore.

The construction and operation of the variable bore ram rubber 20 according to the present invention may be better understood by referring to FIGS. 5 through 7. FIG. 5 illustrates the interrelationship of end inserts 31, corner inserts 32, and center insert 33, as described above. FIG. 5 also illustrates the approximate placement of the inserts in a mold, before the mold is filled with rubber to form the composite molded structure illustrated in FIGS. 1, 6 and 7. Prior to placing the metal inserts in a mold and preparatory to binding the inserts into a rubber matrix, those surfaces of the inserts which are intended to slidingly engage one another may be treated with a mold release agent. This minimizes adherence of rubber to those surfaces, and facilitates displacement of rubber from the treated areas during the flexing of the variable bore ram rubber. Even when mold release agents are applied to the appropriate surface of the inserts, the ram rubber is desirably cycled through a number of compressive sealing and expansive unsealing operations to decrease the effect of undesirable rubber-to-insert bonds which impeded compliant movement of the ram rubber.

FIG. 7 is an upper plan view of a variable bore ram rubber 20 according to the present invention, shown installed in a ram block A of the type shown in FIG. 1. Only the lower front face H of the ram block A appears in the figure, and is shown as a phantom line. Threaded metal screw inserts 82 extend perpendicularly into the rear faces 83 of legs 23 of the ram rubber 20. These are provided to accept fastening bolts for those ram blocks requiring use of fastening bolts.

As shown in FIG. 7, the variable bore ram rubber 20 is in a relaxed, open position. In this position, the rubber matrix in which inserts 31, 32 and 33 are molded extends outwardly from the outer vertical wall surfaces of the inserts to form a boundary layer 84.

Figure 8:
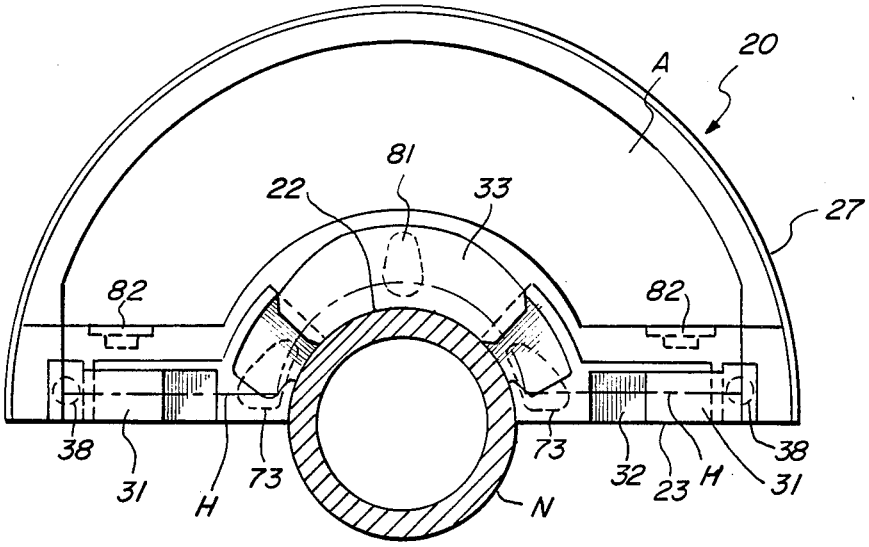
FIG. 8 is an upper plan view similar to that of FIG. 7, but showing the ram rubber compressed against a five-inch diameter pipe.

FIG. 8 illustrates the configuration of variable bore ram rubber 20 when it and an identical lower ram rubber, which is not shown, in a mirror image position, are forced radially inwards towards one another by opposed hydraulic rams, to contact one another and the circumferential surface of a five-inch diameter pipe N. In this position, the contour of the concave arch section 22 of the ram rubber exactly conforms to the outer surface of pipe N, making an effective seal therewith.

Figure 9:
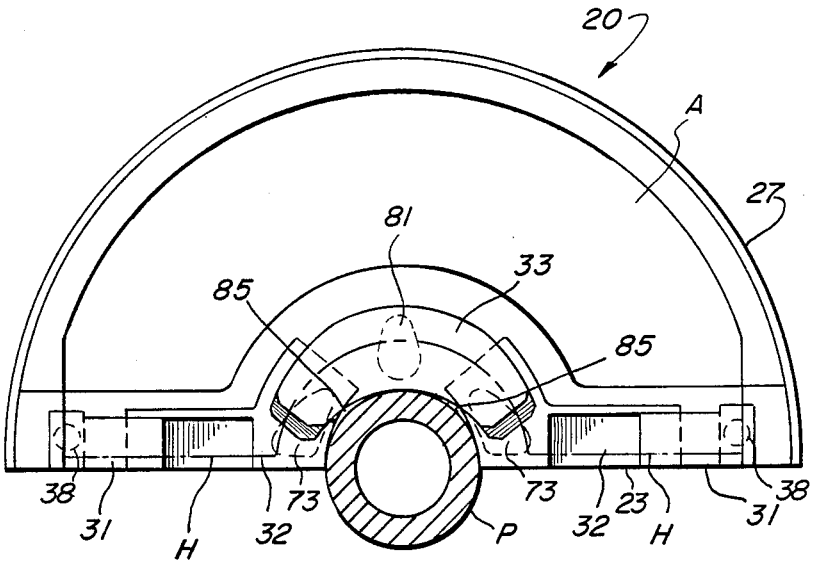
FIG. 9 is an upper plan view similar to that of FIG. 8, but showing the ram rubber compressed against a three and-one half inch diameter pipe.

FIG. 9 shows the configuration of variable bore ram rubber 20 forced against the circumferential surface of a smaller diameter (3½ inch, for example) pipe, than the five inch diameter N of FIG. 8. Perpendicular force exerted on the front vertical faces of legs 23 caused by the hydraulic rams forcing opposed variable bore ram rubbers inwards towards one another causes the rubber of the variable bore ram rubber 20 to cold flow. The cold flow of the rubber causes the end inserts 31 to approach one another, i.e., move radially inwards towards pipe P. Corner inserts 32 are also forced radially inwards towards center insert 33.

In contrast to prior art variable bore ram rubbers having many segments or inserts and therefore many pedestals to impede the cold flow of rubber, the novel variable bore ram rubber according to the present invention has only three pedestals which substantially affect cold flow of rubber. These are the pedestals 73 of the two corner inserts 32, and pedestal 81 of the center insert 33. The skewed, tear drop shaped transverse cross sectional shape of pedestals 73 of the two corner inserts 32 is of the correct hydrodynamic shape to urge rubber flow arcuately inwards towards the rear of pedestal 81 of the center insert 33. Since the narrow end of the tear drop cross sectional shape of pedestal 81 of the center insert 33 points rearward, rubber flowing arcuately backwards of the pedestal urges it forward, forcing the center insert radially outwards towards the circumference of pipe P in the bore of the ram rubber. Thus, the novel use of a sparse number of inserts having a minimum number of hydrodynamically shaped pedestals results in a highly effective control of the cold flow of rubber in the variable bore ram rubber according to the present invention. Rubber from the variable bore ram rubber 20 needs only to extrude into two small crescent shaped regions 85 to form a complete and effective seal around the cylindrical surface of pipe P.

Figure 10:
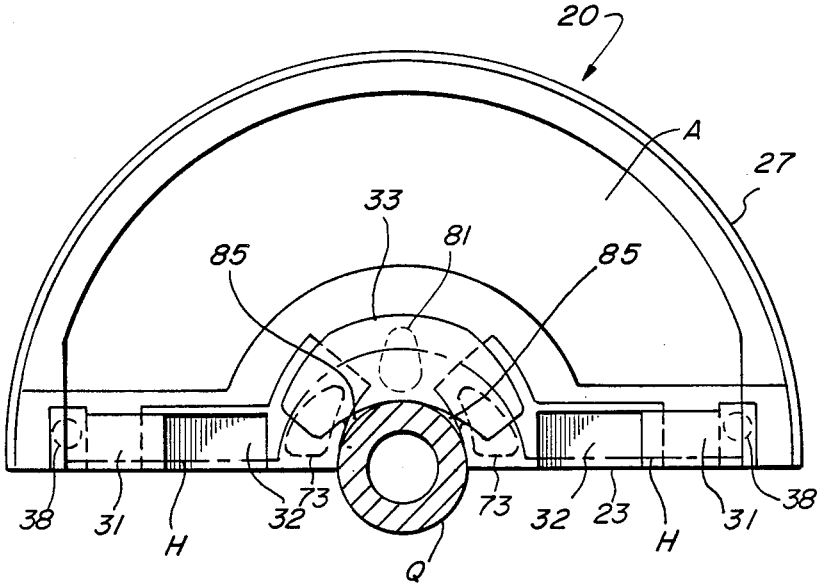
FIG. 10 is an upper plan view similar to that of FIG. 9, but showing the ram rubber compressed against a two and seven-eighths inch diameter pipe.

FIG. 10 shows the configuration of variable bore ram rubber 20 forced against the circumferential surface of the smallest diameter pipe Q which the ram rubber is intended to seal. For example, pipe Q may have a diameter of 2 7/8 inch. In FIG. 10, end inserts 31 have moved laterally inwards their maximum intended distance relative to corner inserts 32. Similarly, corner inserts 32 have moved inwards their maximum intended distance relative to center insert 33.

Figure 11:
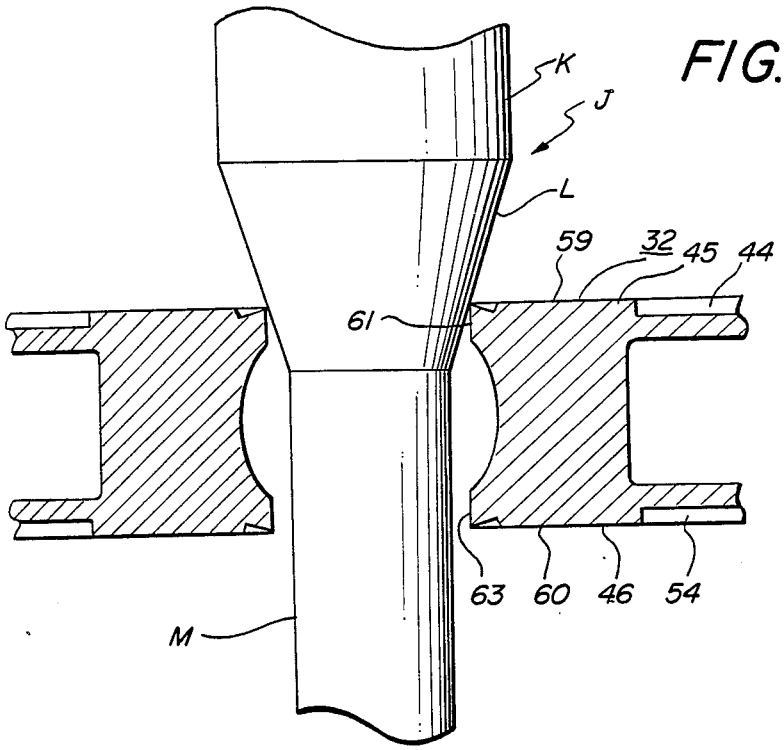
FIG. 11 is a fragmentary longitudinal sectional view of the ram rubber of FIG. 6 showing the corner inserts of the ram rubber contacting a tapered tubular well component disposed longitudinally through the bore of the ram rubber.
Figure 12:
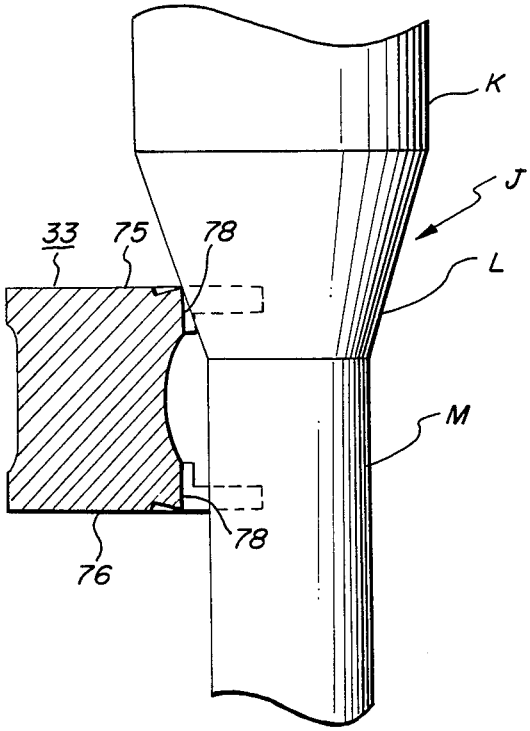
FIG. 12 is a fragmentary longitudinal sectional view similar to that of FIG. 11, but displaced ninety degrees circumferentially from that of FIG. 11, and showing the center insert of the ram rubber contacting a tapered tubular well component.

FIGS. 11 and 12 illustrate a structural feature of the novel variable bore ram rubber 20 according to the present invention which affords a superior capability for supporting straight or tapered piping of great weight in the bore of the ram rubber, in a condition known as "hang off".

As shown in FIG. 11, the upper surface of upper arcuate section 59 of upper plate 45 of corner insert 32 is cut downwards at an angle of approximately 30 degrees at the junction of that surface with inner arcuate edge wall 61 of the upper arcuate section. Similarly, the lower surface of lower arcuate section 60 of lower plate 46 of corner insert 32 is cut upwards at an angle of approximately 30 degrees at the junction of that surface with inner arcuate edge wall 63 of the lower arcuate section. The resultant acute edge angles of 60 degrees are much more effective in biting into and holding pipe J than would be possible with conventional, ninety-degree edges. Thus corner inserts 32 are effective in biting into and holding small diameter section M of pipe J, as well as tapered section L and larger diameter section K.

As shown in FIG. 12, the upper surface of upper plate 75 of center insert 33 is cut downwards at an angle of approximately 30 degrees at the junction of that surface with inner arcuate edge wall 78 of the upper plate. Also, the lower surface of lower plate 76 of center insert 33 is cut upwards at an angle of approximately 30 degrees at the junction of that surface with inner arcuate edge wall 78 of the lower plate. The purpose of the acute edges thereby formed in the center insert 33 is exactly the same as described above for the corner inserts 32. In combination, the acute edges of the corner inserts 32 and center insert 33 provide an improved hang off capability, even if the variable bore ram rubber is tilted or cocked slightly with respect to the longitudinal axis of the pipe.

What is claimed is:

1. A sealing apparatus for forming a fluid pressure-tight seal with at least part of the outer convex surface of a tubular member, said sealing apparatus comprising two identical, laterally opposed sealing elements having in plan view a generally semi-circular shape and adapted to abut one another along a front diametrical plane, each sealing element comprising;

a. a skeletal structure having a in plan view the shape of a generally uniform strip having a generally semicircular midsection having a concave front wall surface and two symmetrical elongated rectangular legs extending symmetrically and generally laterally outwards from opposite ends of said semi-circular midsection, said skeletal structure being formed of a plurality of rigid inserts, each of said inserts having a pair of generally parallel and similarly shaped upper and lower plates, each pair of said plates being joined together by a columnar pedestal disposed between the inner, facing surfaces of said pair of plates, said inserts being positioned adjacent one another to form a structure having a central traverse symmetry plane, said plates of said inserts adjacent to one another slidably engageable with one another to permit slidable relative motion parallel to said transverse symmetry plane, said inserts of each element comprising;

(i) a pair of end inserts each having elongated rectangular plan view bar-shaped upper and lower plates, one each of said pair of end inserts being located at a respective outer lateral end of each of said elongated rectangular legs;

(ii) a corner insert adjacent each of said end inserts, the corner inserts having upper and lower plates each of which has a generally bar-shaped outer lateral end slidably engageable with said upper and lower plates, respectively, of an adjacent end insert, the inner lateral ends of said upper and lower plates of said corner insert having concave, arcuately curved section, and (iii) a center insert having upper and lower plates curved to form an annular section, the outer radial edges of said plates slidingly engageable with said upper and lower arcuately curved inner sections, respectively, of an adjacent one of said corner inserts, b. a matrix of resilient material molded around each said skeletal structure to form a composite structure having generally flat and parallel surface symmetrical about said central transverse symmetry plane, said composite structure having in plan view the general outline of said skeletal structure, said matrix having a front wall surface adjacent said front diametrical plane of said sealing element and parallel to but extending slightly away from the skeletal structure to which the respective matrix is molded, and c. means for fastening said composite structure to a forceproducing member capable of applying a force normal to said front wall surface of said composite structure.

2. The sealing apparatus of claim 1 wherein each sealing element of said front diametrical wall surface of said matrix is substantially perpendicular to said upper and lower surfaces of said composite structure.

3. The sealing apparatus of claim 2 wherein said skeletal structure and said matrix have formed in said front wall a concave tubular cavity disposed longitudinally through said sealing element and adapted to conform to said convex surface of said tubular member.

4. The sealing apparatus of claim 3 wherein said semi-circular midsection of each sealing element has in plan view a substantially semi-circular shape.

5. The sealing apparatus of claim 4 wherein the front faces of said elongated rectangular legs of each sealing element are substantially coplanar.

6. The sealing apparatus of claim 4 wherein said columnar pedestal joining said upper and lower plates of said corner insert of each sealing element is located at the intersection of said bar-shaped section and said arcuately curved section of said plates.

7. The sealing apparatus of claim 6 wherein the cross-sectional shape of said columnar pedestal is that of a tear drop, the smaller end of which points generally rearward of the front diametrical wall surface of said matrix, the major axis of the tear drop bending arcuately to conform generally to the contour of said arcuately curved section, whereby resilient material forced inwards from the front diametrical wall of said sealing element by an inward normal force exerted on the wall is urged arcuately inward towards said center insert.

8. The sealing apparatus of claim 4 wherein said columnar pedestal joining said upper and lower plates of said center insert of each sealing element is located midway between said outer radial edges of said plates.

9. The sealing apparatus of claim 8 wherein the cross-sectional shape of said columnar pedestal is that of a tear drop, the larger end of which points towards the front diametrical wall of said sealing element, whereby resilient material arcuately forced rearwards from said front diametrical wall by an inward normal force exerted on said wall is urged forward around said pedestal and is directed by said pedestal to sealingly contact the outer surface of a tubular member longitudinally disposed within said arched mid section.

* * * * *